US006942036B2

(12) United States Patent
Gabrysch et al.

(10) Patent No.: US 6,942,036 B2
(45) Date of Patent: Sep. 13, 2005

(54) TREATING APPARATUS AND METHOD FOR EXPANDABLE SCREEN SYSTEM

(75) Inventors: Allen D. Gabrysch, Houston, TX (US); William N. Triplett, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 191 days.

(21) Appl. No.: 10/118,841

(22) Filed: Apr. 9, 2002

(65) Prior Publication Data

US 2003/0188874 A1 Oct. 9, 2003

(51) Int. Cl.[7] ..... E21B 43/10

(52) U.S. Cl. ..... 166/312; 166/207; 166/380; 166/382; 166/227

(58) Field of Search ..... 166/227, 380, 166/382, 376, 206, 207, 312

(56) References Cited

U.S. PATENT DOCUMENTS

| | | | | |
|---|---|---|---|---|
| 3,191,680 | A | | 6/1965 | Vincent |
| 3,419,080 | A | | 12/1968 | Lebourg |
| 3,482,629 | A | | 12/1969 | Suman, Jr. |
| 3,861,465 | A | | 1/1975 | Mignotte |
| 4,253,522 | A | | 3/1981 | Setterberg, Jr. |
| 4,498,536 | A | | 2/1985 | Ross et al. |
| 5,058,676 | A | | 10/1991 | Fitzpatrick et al. |
| 5,366,012 | A | | 11/1994 | Lohbeck |
| 6,263,966 | B1 | | 7/2001 | Haut et al. |
| 6,263,972 | B1 | | 7/2001 | Richard et al. |
| 6,543,545 | B1 | * | 4/2003 | Chatterji et al. ..... 166/381 |
| 6,568,472 | B1 | * | 5/2003 | Gano et al. ..... 166/207 |
| 2003/0106689 | A1 | * | 6/2003 | Nguyen ..... 166/278 |

FOREIGN PATENT DOCUMENTS

| | | |
|---|---|---|
| WO | WO 99/56000 | 11/1999 |
| WO | WO 02/01042 A1 | 1/2002 |

* cited by examiner

*Primary Examiner*—Hoang Dang
(74) *Attorney, Agent, or Firm*—Steve Rosenblatt

(57) ABSTRACT

A tool and method for treating an open hole just before expanding a screen into position is described. The swage is hydraulically driven and permits flow through it and out lateral ports to impact the borehole wall. A cup seal assembly below and a packer up above insure that the fluid impacts the borehole wall with sufficient force to dislodge the mud cake. Another feature of the invention is that the surface treatment and screen expansion can be done in one trip. The pressurized fluid that drives the swage also provides the fluid energy to prepare the borehole wall just before the screen is expanded against it.

19 Claims, 1 Drawing Sheet

TREATING APPARATUS AND METHOD FOR EXPANDABLE SCREEN SYSTEM

FIELD OF THE INVENTION

The field of this invention relates to screens that can be expanded downhole and has capabilities to treat the wellbore wall ahead of expansion.

BACKGROUND OF THE INVENTION

Gravel packing is a common completion method where a zone in a perforated cased hole is isolated after a screen assembly is put into place. A crossover tool allows the sand to be deposited on the outside of the screen with fluid returns coming back to the surface through the crossover tool. Many variations on the basic gravel packing technique are known and U.S. Pat. No. 4,253,522 is but one example.

More recently, the gravel packing of screens has been replaced, particularly in open hole, by a technique involving expanding slotted liners or screens. U.S. Pat. Nos. 5,366,012 and 6,263,966 are respectively illustrative of these two completion techniques. U.S. Pat. No. 3,482,629 illustrates a technique using patches that can be expanded to fill holes in screens.

Also known in the context of cased and perforated wellbores is the technique of isolating perforations between a pair of seals and chemically treating them with pumped fluids. Illustrative of this technique are U.S. Pat. Nos. 3,861,465 and 4,498,536. BJ Services offers a Roto Jet tool for placement of treating acid.

One issue in reliable screen operation is the mud cake on the wall of an uncased hole in which the screen is to be expanded. Expansion of the screen into the mud cake will adversely affect its subsequent performance and could lead to premature plugging. On the other hand, for certain operations in open hole, the presence of mud cake can reduce fluid losses into the formation. What is needed is a way to treat or clean up the open hole around the time when a screen assembly is being expanded or shortly thereafter. There is a disadvantage to a delay between removing the mud cake and expanding the screen as in the interim the dislodged cake can redeposit itself in the time it takes to jet or clean the uncased hole and when the screen is in place for expansion in a subsequent run.

Accordingly, one of the objectives of the present invention is to provide a method where the open hole is treated in advance of a screen expansion. Another objective is to treat the borehole wall and expand the screen assembly in a single trip. These and other advantages of the present invention will become more readily apparent to those skilled in the art from a review of the description of the preferred embodiment and the claims, which appear below.

SUMMARY OF THE INVENTION

A tool and method for treating an open hole just before expanding a screen into position is described. The swage is hydraulically driven and permits flow through it and out lateral ports to treat the borehole wall. A cup seal assembly below and a packer up above insure that the fluid remains where needed to dislodge the mud cake. Another feature of the invention is that the surface treatment and screen expansion can be done in one trip. The pressurized fluid that drives the swage also provides the fluid energy to treat the borehole wall just before the screen is expanded against it.

DETAILED DESCRIPTION OF THE DRAWINGS

DETAILED DESCRIPTION OF THE PREFERRED EMBODIMENT

Figure 1:
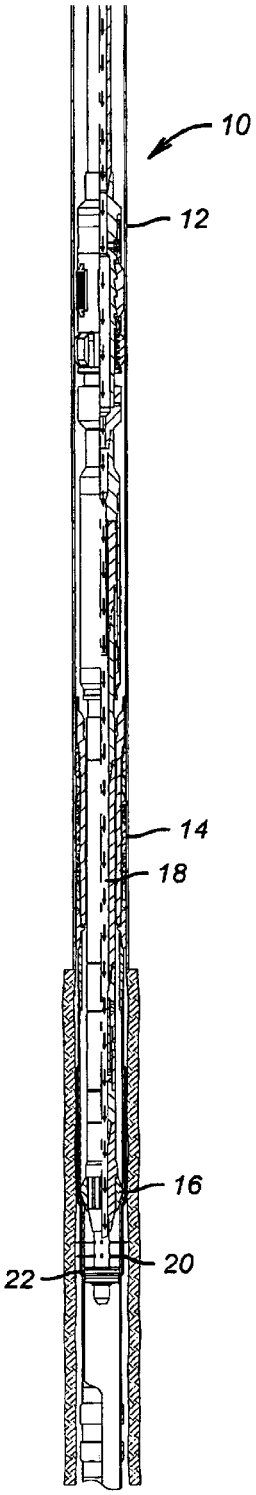
FIG. 1 is a sectional schematic view of the one trip assembly to treat the borehole wall surface just before expanding the screen assembly.
Figure 2:
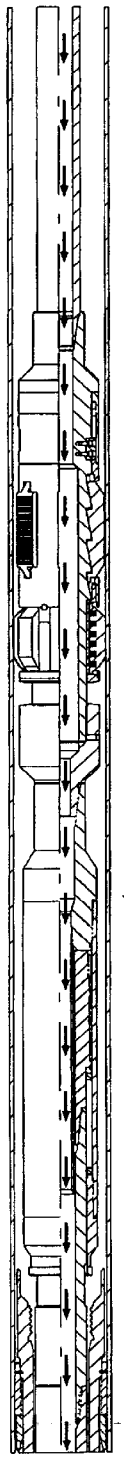
FIG. 2 is a closer view of the top portion of FIG. 1.
Figure 3:
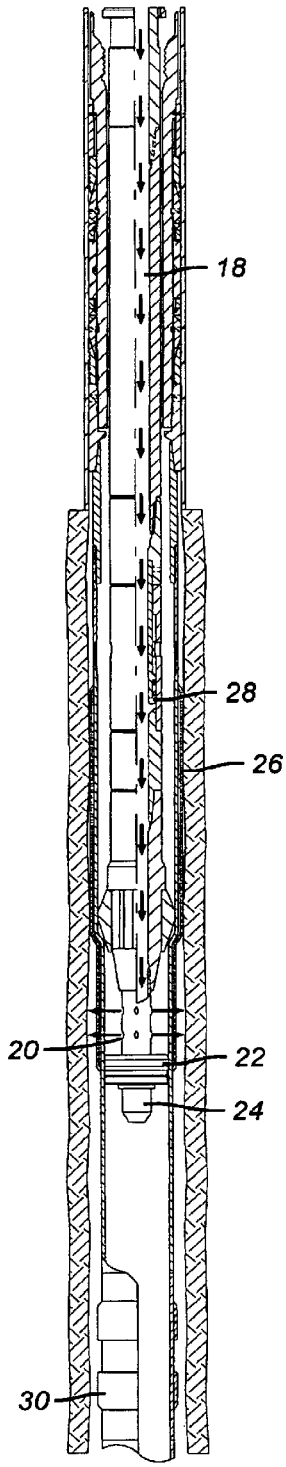
FIG. 3 is a closer view of the bottom portion of FIG. 1.

FIG. 1 shows the one trip assembly. At the top is an anchor 10 that has tubing 12 suspended from its lower end and extending though a packer 14. A swage 16 is telescopingly mounted to the tubing 12 so that the swage 16 can advance with respect to the anchor 10, which is stationary after it is set. A flow passage 18 extends through tubing 12 to lateral outlets 20. One or more cup seals or equivalent 22 are below lateral outlets 20 and above the closed lower end 24.

The entire assembly is positioned in the well and the packer 14 is set in a known manner. The swage 16 is positioned at the top of screen 26 for run in. Thereafter, the anchor 10 is set, preferably in a cased portion of the wellbore. Pressure is applied to the flow path 14 from the surface. This pressure drives the known telescoping joint 28 so that the swage 16 advances through the screen 26. At the same time, the treating chemicals flow through lateral outlets 20 to treat the borehole wall and remove the mud cake just before a portion of the screen 26 is expanded into close contact with the borehole wall due to the action of swage 16. If the screen length exceeds the stroke length of the telescoping joint 28, the anchor 10 is released and weight is set down. The anchor is then reset and the cycle is repeated as many times as required until the entire screen 26 is expanded just behind the treating chemicals contacting the borehole wall through lateral outlets 20.

Those skilled in the art will appreciate that the direction of expansion can be in the uphole rather than the downhole direction. The cup seals or equivalent 22 help retain the treating fluid between themselves and packer 14. Down below there is another packer 30 to isolate other producing zones in the wellbore. Optionally, the lateral outlets can be below the screen 26 to treat the borehole wall as the screen 26 is advanced into position by lowering the tubing 12 through packer 14. When the screen 26 reaches the desired location applying a higher pressure than the pressure used to simply treat the borehole wall as a preliminary matter can actuate the swage. The system is far less complicated if the assembly is delivered into final position with the swage 16 at one end of the screen 26. In the preferred embodiment, the top end of the screen 26 is where the swage 16 and the lateral outlets 20 are located for run in. The number and orientation of the openings 20 can be varied. Other seal types than cup seals can be used for seals 22 for treatment fluid containment. The pressure source for the fluid treatment, which does double duty by driving the swage 16, can come from the surface or from a downhole pressure source such as a pump. Although a screen 26 is preferred, the method can be used with tubulars that are perforated with a variety of shapes such as holes or slots. Although chemical treatment is contemplated treatment using the energy of the fluid as a jet cleaner can also be employed using either the chemical for treating and jetting or even distinct fluids if both techniques are used simultaneously or a non-treating fluid if just the jet action is relied upon for treating. Those skilled in the art will appreciate that "treating" comprises any of these possibilities alone or in combination.

The present invention allows for a one-trip system to expand a screen or tubular and treat the borehole wall. These events can occur simultaneously or either one before the other. The screen or tubular is expanded shortly after the same region has been treated. This combination promotes good subsequent performance in producing or injection well environments. The confinement of the treating fluids to a short interval by the use of cup seal or equivalent 22 ensures that the mud filter cake is effectively removed.

The foregoing disclosure and description of the invention are illustrative and explanatory thereof, and various changes in the size, shape and materials, as well as in the details of the illustrated construction, may be made without departing from the spirit of the invention.

We claim:

1. A well completion method, comprising:

isolating a section of a borehole from above and below;

treating said isolated section of the borehole to reduce drilling fluid filter cake deposits; and expanding a screen or a tubular with openings in said isolated section.

2. The method of claim 1, comprising:

performing said treating and said expansion in a single trip into the well.

3. The method of claim 1, comprising:

expanding said screen or tubular with openings in the area of said treating.

4. The method of claim 1, comprising:

pressurizing treating fluid for delivery into the well; and using said pressurized treating fluid for said expanding.

5. The method of claim 4, comprising:

driving a swage with said pressurized treating fluid.

6. The method of claim 1, comprising:

performing said treating and said expansion at the same time.

7. The method of claim 1, comprising:

conducting said treating through said screen or said openings in said tubular with openings.

8. The method of claim 2, comprising:

pressurizing treating fluid for delivery into the well; and using said pressurized treating fluid for said expanding.

9. The method of claim 8, comprising:

driving a swage with said pressurized treating fluid.

10. The method of claim 9, comprising:

performing said treating and said expansion at the same time.

11. The method of claim 10, comprising:

expanding said screen or tubular with openings from its uphole end to its downhole end;

flowing pressurized treating fluid though a swage to outlets mounted below said swage.

12. The method of claim 8, comprising:

conducting said treating through said screen or said openings in said tubular with openings.

13. A well completion method, comprising:

isolating a section of a borehole from above and below;

treating the borehole to reduce drilling fluid filter cake deposits; and expanding a screen or a tubular with openings in the well;

expanding said screen or tubular with openings from its uphole end to its downhole end;

flowing pressurized treating fluid though a swage to outlets mounted below said swage and in said isolated section.

14. The method of claim 13, comprising:

using said pressurized treating fluid to drive said swage.

15. A well completion method, comprising:

treating the borehole to reduce drilling fluid filter cake deposits; and expanding a screen or a tubular with openings in the well;

expanding said screen or tubular with openings from its uphole end to its downhole end;

flowing pressurized treating fluid though a swage to outlets mounted below said swage;

using said pressurized treating fluid to drive said swage;

mounting said swage on a tubular string that extends through a packer;

setting said packer before said treating or said expanding;

providing a seal on said string below said outlets;

isolating said pressurized treating fluid between said packer and said seal.

16. The method of claim 15, comprising:

using at least one cup seal as said seal.

17. A well completion method, comprising:

treating the borehole to reduce drilling fluid filter cake deposits; and expanding a screen or a tubular with openings in the well;

conducting said treating below said screen or said tubular with openings;

advancing said screen or tubular with openings to the location just treated prior to said expanding.

18. A well completion method, comprising:

treating the borehole to reduce drilling fluid filter cake deposits; and expanding a screen or a tubular with openings in the well;

performing said treating and said expansion in a single trip into the well;

expanding said screen or tubular with openings in the area of said treating;

pressurizing treating fluid for delivery into the well;

using said pressurized treating fluid for said expanding;

driving a swage with said pressurized treating fluid;

performing said treating and said expansion at the same time;

expanding said screen or tubular with openings from its uphole end to its downhole end;

flowing pressurized treating fluid though a swage to outlets mounted below said swage;

mounting said swage on a tubular string that extends through a packer;

setting said packer before said treating or said expanding;

providing a seal on said string below said outlets;

isolating said pressurized treating fluid between said packer and said seal.

19. A well completion method, comprising:

treating the borehole to reduce drilling fluid filter cake deposits; and expanding a screen or a tubular with openings in the well;

performing said treating and said expansion in a single trip into the well;

expanding said screen or tubular with openings in the area of said treating;

pressurizing treating fluid for delivery into the well;

using said pressurized treating fluid for said expanding;

conducting said treating below said screen or said tubular with openings;

advancing said screen or tubular with openings to the location just treated prior to said expanding.

* * * * *